United States Patent [19]

Faltersack

[11] 3,980,608

[45] Sept. 14, 1976

[54] KNIFE RACK WHICH SELF-ADJUSTS TO BLADE THICKNESS

[76] Inventor: Edward J. Faltersack, 19517 Almadon Road, San Jose, Calif. 95120

[22] Filed: June 23, 1975

[21] Appl. No.: 589,033

[52] U.S. Cl. ..... 248/37.3; 211/89

[51] Int. Cl.[2] ..... A47G 21/14

[58] Field of Search ..... 211/60 R, 60 T, 89, 211/120, 69, 72, 51; 248/37.3, 37.6; 312/42

[56] References Cited

UNITED STATES PATENTS

| | | | |
|---|---|---|---|
| 1,214,606 | 2/1917 | Steig | 211/120 |
| 1,861,683 | 6/1932 | Branch | 211/60 T X |
| 1,894,974 | 1/1933 | Bleckley | 248/37.6 X |
| 1,980,557 | 11/1934 | Snitzer | 211/89 X |
| 2,325,604 | 8/1943 | Gibbs et al. | 248/37.3 |

*Primary Examiner*—James T. McCall
*Assistant Examiner*—Robert W. Gibson, Jr.
*Attorney, Agent, or Firm*—Boone, Schatzel & Hamrick

[57] ABSTRACT

A rack for holding knives comprising a housing including parallel first and second sidewalls interconnected by a base and having an opening therebetween, fasteners for mounting the housing to an associated surface such that the sidewalls are vertically oriented, and a plurality of partition members disposed in a stacked relationship on the base between and vertically movable within the sidewalls, each member being formed from a unitary body of resilient material including an elongated portion having a blade-holding surface and terminating in a blade guiding portion disposed in a facing relationship to the opening, the blade-holding surface of a first member being disposed subjacent the blade-guiding portion of a second member and cooperating therewith to form a blade-holding recess, whereby when the blade of a knife is inserted into the rack the blade-guiding portion serves to guide the tip of the blade into the recess forcing the members above the knife upward to accommodate the blade, the weight of the members above the knife serving to maintain the blade in the recess.

6 Claims, 9 Drawing Figures

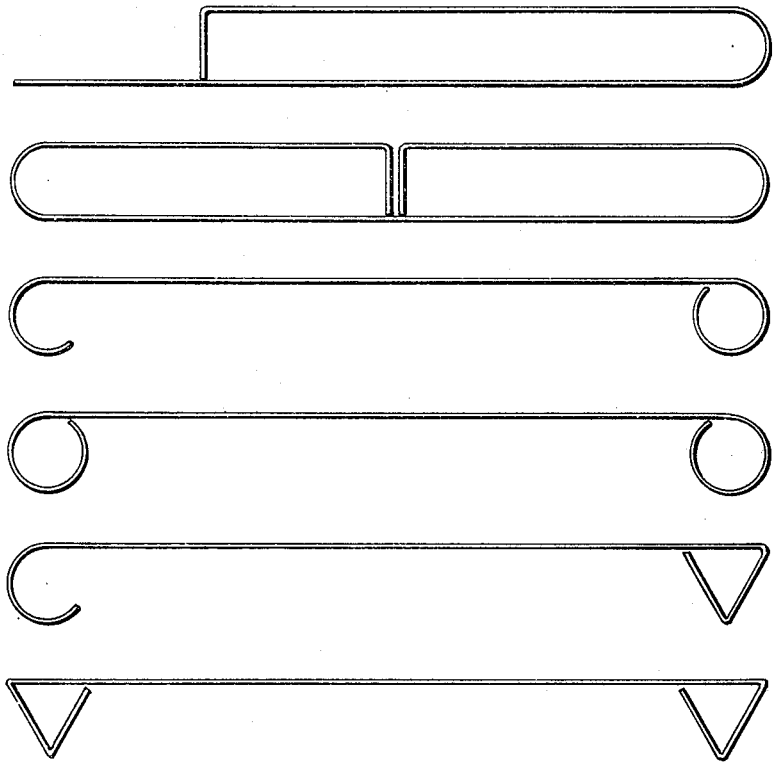
FIG. 3A
FIG. 3B
FIG 3C
FIG. 3D
FIG. 3E
FIG. 3F
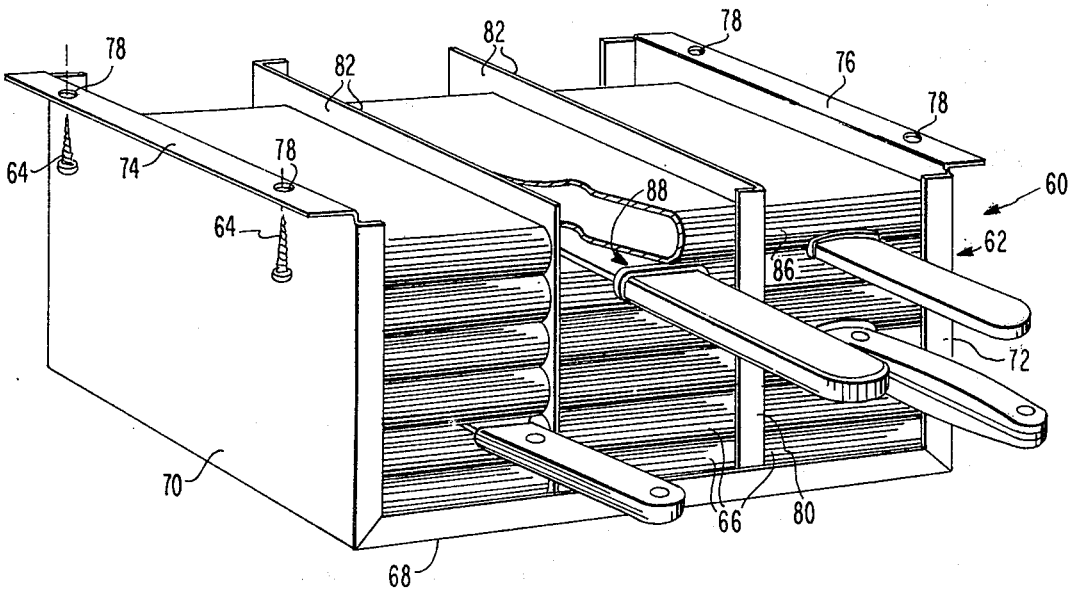
FIG.4

KNIFE RACK WHICH SELF-ADJUSTS TO BLADE THICKNESS

BACKGROUND OF THE INVENTION

1. Field of the Invention

The present invention relates generally to racks, and more particularly to apparatus for supporting a plurality of knives and analogous bladed articles of cutlery.

2. Description of the Prior Art

Heretofore knife racks for use in the household kitchen have conventionally included several separated slots having fixed dimensions for receiving knife blades of particular widths. Such racks have been adapted to be mounted on a vertical surface so that the handle of the knife is in an upright position. A disadvantage of racks of this type is that when a knife is inserted into a slot that is either too narrow or too short, the knife would either not be able to be received by the rack or would have a tendency to fall out of the rack. In addition, in mounting the rack at a height which allows the user easy access to the upright knife handles, a safety hazard may be created since the rack may be low enough to be within easy access to small children.

In the patent art, several patents teach knife racks. In particular, U.S. Pat. No. 2,453,800, entitled "Knife Rack" by G. H. Lowell, Jr.; U.S. Pat. No. 2,571,972, entitled "Holding Rack" by W. L. Wagner; U.S. Pat. No. 2,639,038, entitled "Meat Knife Holder" by N. A. Merritt; and U.S. Pat. No. 2,955,789, entitled "Knife Rack" by R. B. Smith, teach knife racks in which the knives are maintained in an upright position.

SUMMARY OF THE PRESENT INVENTION

Accordingly, it is an object of the present invention to provide a knife rack in which the knife blades are mounted horizontally in recesses which self-adjust to the thickness of the knife blade.

Other objects of the present invention are to provide a knife rack which is simple to construct and is capable of holding many different-sized knives which may be inserted from either end of the rack.

Yet another object of the present invention is to provide a knife rack which is able to hold one or two knives of the same or of different sizes in any of its knife receiving recesses.

Briefly, the preferred embodiment comprises a housing including parallel first and second sidewalls interconnected by a base and having an opening therebetween, fasteners for mounting the housing to an associated surface such that the sidewalls are vertically oriented, and a plurality of partition members disposed in a stacked relationship on the base between and vertically movable within the sidewalls, each member being formed from a unitary body of resilient material including an elongated portion having a blade-holding surface and terminating in a blade-guiding portion disposed in a facing relationship to the opening, the blade-holding surface of a first member being disposed subjacent the blade-guiding portion of a second member and cooperating therewith to form a blade-holding recess.

When the blade of a knife is inserted into the rack the blade-guiding portion serves to guide the tip of the blade into the recess, forcing the members above the knife upward to accommodate the blade, the weight of the members above the knife serving to maintain the blade in the recess.

An advantage of the present invention is that it includes knife holding recesses which self-adjust to the thickness of the blade being inserted.

Another advantage of the present invention is that it is simple to construct and is capable of holding different-sized knives in any of its knife holding recesses.

The foregoing and other objects, features and advantages of the invention will be apparent from the following detailed description of the preferred embodiments illustrated in the several figures of the drawing.

IN THE DRAWING

FIGS. 3A–3F are side elevational views of several alternate embodiments of the partition member of the present invention; and FIG. 4 is a perspective view of an alternate embodiment of the present invention with portions broken away for clarity.

DETAILED DESCRIPTION OF THE PREFERRED EMBODIMENT

Figure 1:
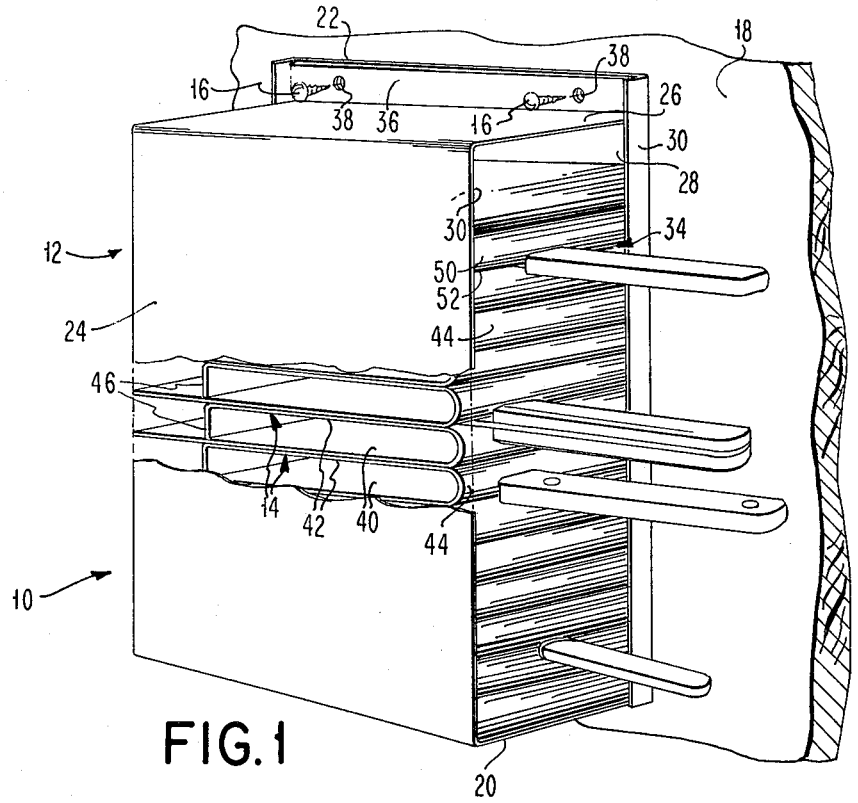
FIG. 1 is a perspective view of a knife rack in accordance with the present invention with portions broken away for clarity.
Figure 2:
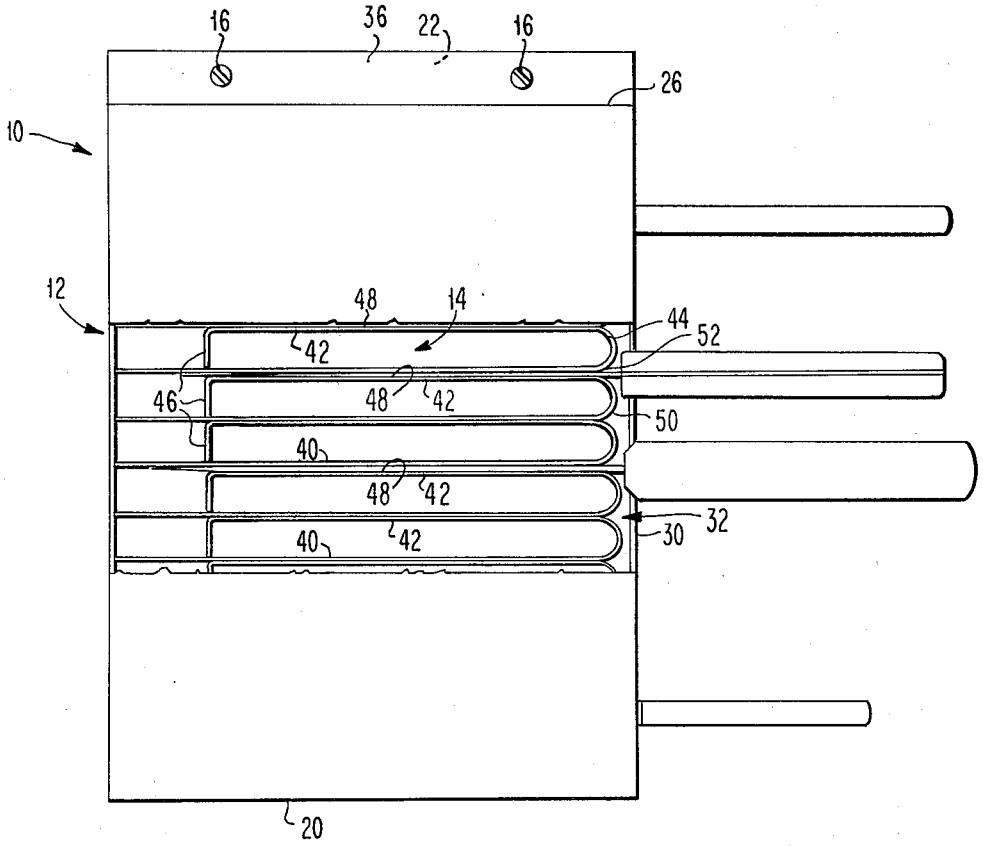
FIG. 2 is a side elevational view of FIG. 1 with portions broken away for clarity.

FIGS. 1 and 2 illustrate in a perspective and a front elevational view, respectively, a knife rack 10 in accordance with the present invention. The rack 10 includes a housing 12, a plurality of partition members 14 disposed within the housing and fasteners 16 for mounting the housing to a preselected surface 18.

The housing 12 or frame, includes a rectangularly-shaped base 20, a pair of rectangularly-shaped sidewalls 22 and 24 extending upwardly in a parallel manner from the opposed ends of the base and a cover 26. Accordingly, the inner surfaces 28 and 30 of the respective sidewalls 22 and 24 are parallel and serve to guide the movement of the members 14. The sidewall 22 includes lip portions 32, which partially cover opposed openings 34 formed between the sidewalls, and a pair of spaced-apart holes (not shown) near its upper end. The cover 26 includes an upturned portion 36 which is disposed adjacent the upper end of the sidewall 22 and has a pair of holes 38 in alignment with the holes in the sidewall 22. The fasteners 16, which may be in the form of screws, are adapted to be received through the aligned holes 38 and serve to mount the housing 12 to the vertical surface 18.

Each partition member 14 is formed from a unitary body and includes an elongated bottom portion 40, an elongated top portion 42 disposed substantially parallel to the bottom portion, an arcuate bight portion 44 interconnecting the bottom and top portions, and a spacer portion 46 extending normally from the distal end of the top portion toward the bottom portion intermediate its ends (see FIGS. 2 and 3A). The bottom portion 40 is rectangular in plan view and is adapted to fit within the housing 12 with its long edges snugly adjacent the respective inner surfaces 28 and 30. The top portion 42 is also rectangular in plan view and includes a flat top surface 48 which serves to support the blade of a knife or other article of cutlery when placed thereon. The elongated edges of the top portion 42 are snugly adjacent the respective inner surfaces 28 and 30. The outer surface 50 of the bight portion 44 and the bottom portion 40 is smooth and serves to guide the blade of the knife in a prescribed manner.

The spacer portion 46 has a dimension sufficient to maintain the top and bottom portions 42 and 40 in a substantially parallel relationship.

In a preferred embodiment, the member 14 is formed from a unitary rectangular sheet of resilient material such as sheet steel in the range between 20 and 26 gage, and the top portion extends about three-quarters of the length of the bottom portion. Also, the angle of curvature subtended by the ends of the bight portion is slightly less than 180° such that the distal end of the spacer portion 46 is spaced slightly away from the bottom portion 40 when no weight is applied to the top surface 48.

A plurality of the partition members 14 are disposed in a stacked relationship on the base 20 with the elongated edges of the respective top and bottom portions adjacent the surfaces 28 and 30, the bight portion 44 facing the opening 34 and the top surface 48 of one member being disposed subjacent the outer surface 50 of another member so as to form a blade-holding recess 52.

In operation, the fasteners 16 are inserted through the holes 38 and into the surface 18 so as to mount the housing 12 with the inner surfaces 28 and 30 extending in a vertical direction. When the blade of a knife is inserted into a preselected recess 52, the blade guiding surface 50 serves to guide the top of the blade into the recess. As the blade is pushed further into the recess 52, the partition members 14 above the knife are forced upward to accommodate the blade. Once the blade is fully inserted, it is supported by the surface 48 and maintained in the recess 52 by the weight of the members thereabove.

Refering now to FIGS. 3B–3F several alternative embodiments of partition members are illustrated in a side elevational view.

An alternate embodiment of the present invention is illustrated in a perspective view in FIG. 4. The fundamental differences in this embodiment are that the rack is adapted to be mounted to a horizontal surface, such as the underside of a counter, and that the partition members are disposed in three adjacent columns.

As illustrated, a rack 60 comprises a housing 62, fasteners 64 and a plurality of partition members 66.

The housing 62 includes a base 68 and sidewalls 70 and 72 which terminate in outwardly directed flanges 74 and 76 respectively. Each of the flanges 74 and 76 has a pair of holes 78 therethrough which serve to receive the fasteners 64 for affixing the housing to a horizontal surface. Extending upwardly from the base 68 intermediate the sidewalls 70 and 72 are a pair of walls 80 which are parallel to the sidewalls and which have outer surfaces 82 that cooperate with a facing surface of the adjacent wall 80 or sidewall 70 and 72, and serve to guide the partitions 66. The partitions 66 are constructed similarly to those previously described and includes a blade-holding portion 84, and a blade-guiding portion 86, and cooperate with a subjacent partition to form a recess 88 therebetween. The inclusion of the two walls 80 enables three columns of partitions 66 to be housed within the enclosure.

By providing several columns of adjacent partitions, a preselected number of knife receiving recesses 88 are formed in racks which have less vertical length than those illustrated in FIG. 1.

In response to the insertion of a blade of a knife, the blade-guiding portion 86 guides the tip of the blade into the recess 88. Continued insertion of the blade forces the members 66 above the blade upward to accommodate the blade. Once the blade is fully inserted, it is maintained in a horizontal position in the recess 88 by the weight of the members 66 above it.

It can be seen that there has been provided with this invention a knife rack which is capable of supporting a pluality of assorted knives and cutlery in a readily available manner. The knife rack permits quick and easy insertion of and withdrawal of the knives, while preventing the knives from inadvertently falling out during storage.

While the invention has been particularly shown and described with reference to certain preferred embodiments, it will be understood by those skilled in the art that various alterations and modifications in the form and detail may be made therein. Accordingly, it is intended that the following claims cover all such alterations and modifications as fall within the true spirit and scope of the invention.

What is claimed is:

1. A rack for holding knives comprising:

a housing including parallel first and second sidewalls interconnected by a base and having an opening therebetween;

means for fastening said housing to an associated surface such that said sidewalls are vertically oriented; and a plurality of partition members disposed in a stacked relationship on said base between and vertically movable within said sidewalls, each member being formed from a unitary body of resilient material and including an elongated portion having a blade-holding surface, a bottom portion, a bight portion interconnecting said bottom and said elongated portions and disposed in a facing relationship to said opening, and a spacer portion, said spacer portion and said bight portion serving to maintain said elongated and bottom portions in a substantially parallel relationship, and said bight portion serving to normally bias said elongated portion in a direction away from said bottom portion, the blade-holding surface of a first partition member being disposed subjacent the bottom portion of a second partition member and cooperating therewith to form a blade-holding recess, whereby when the blade of a knife is inserted into the rack said bight portion and said bottom portion serve to guide the tip of the blade into said recess forcing the members above the knife upward to accommodate the blade, the weight of the members above the knife serving to maintain the blade in said recess and whereby said blade-holding surface of said first partition exerts an upwardly directed force which also serves to maintain the blade in said recess.

2. A rack for holding knives as recited in claim 1 wherein said body is formed from a sheet of sheet metal.

3. A rack for holding knives as recited in claim 1 wherein said sidewalls each include a top portion having first and second spaced-apart holes, said first holes being aligned and said second holes being aligned and wherein said means for fastening includes first and second screws for insertion through said first and second holes, respectively.

4. A rack for holding knives as recited in claim 1 and further including at least one wall extending upwardly from said base parallel to and intermediate said sidewalls, adjacent ones of said at least one wall and said sidewalls each serving to receive a plurality of members in a stacked relationship.

5. A rack for holding knives as recited in claim 1 wherein said housing includes stop means arranged in a covering relationship over a portion of said opening to maintain said members in said housing.

6. A rack for holding knives comprising:

a housing including parallel first and second sidewalls interconnected by a base and having opposed openings therebetween means for fastening said housing to an associated surface such that said sidewalls are vertically oriented; and a plurality of partition members disposed in a stacked relationship on said base between and vertically movable within said sidewalls, each member being formed from a unitary body including a first elongated portion having a blade-holding surface, a second elongated portion having a blade-holding surface a flat bottom portion, first and second bight portions interconnecting respective ends of said bottom portion and said first and second elongated portions and disposed in facing relationship to said respective openings, said first and second spacer portions for respectively maintaining said elongated portions a preselected spacing from said bottom portion, the blade-holding surfaces of a first partition member being disposed subjacent the bottom portion of a second partition member and cooperating therewith to form opposed blade-holding recesses, whereby when the blade of a knife is inserted into the rack through either opening one of said bight portions and said bottom portion serve to guide the tip of the blade into said recess forcing the members above the knife upward to accommodate the blade, the weight of the members above the knife serving to maintain the blade in said recess.

* * * * *

UNITED STATES PATENT OFFICE

CERTIFICATE OF CORRECTION

Patent No. 3,980,608 Dated September 14, 1976

Inventor(s) Edward J. Faltersack

It is certified that error appears in the above-identified patent and that said Letters Patent are hereby corrected as shown below:

Column 3, line 34, "Refering" should read--Referring--;

Column 6, line 5, delete "said" and insert therefor--and--.

Signed and Sealed this

Ninth Day of November 1976

[SEAL]

*Attest:*

RUTH C. MASON
*Attesting Officer*

C. MARSHALL DANN
*Commissioner of Patents and Trademarks*